United States Patent [19]

Adlam et al.

[11] Patent Number: 4,671,162

[45] Date of Patent: Jun. 9, 1987

[54] PROTECTIVE BOX FOR EXPLOSIVE LINE LAUNCHER

[75] Inventors: Arthur H. Adlam, Sterling Heights; Donald R. Wittbrodt, Warren; Andrew J. Scully, Mt. Clemens; Roger R. Smith, Imlay City; Balbir S. Tuteja, Sterling Heights; Theodore R. Currier, Clawson, all of Mich.; Rita M. George, Chevy Chase, Md.; Roger W. Yopp, Houston, Tex.; Syed M. Hussaini, Sterling Heights, Mich.

[73] Assignee: The United States of America as represented by the Secretary of the Army, Washington, D.C.

[21] Appl. No.: 856,260

[22] Filed: Apr. 28, 1986

[51] Int. Cl.[4] ..... E41H 11/12

[52] U.S. Cl. ..... 89/1.13; 89/36.08

[58] Field of Search ..... 89/1.13, 1.34, 36.08, 89/36.13

[56] References Cited

U.S. PATENT DOCUMENTS

| | | | |
|---|---|---|---|
| 3,242,862 | 3/1966 | Stegbeck et al. | 89/1.13 X |
| 3,303,740 | 2/1967 | Grayson et al. | 89/1.8 UX |

FOREIGN PATENT DOCUMENTS

| | | | |
|---|---|---|---|
| 2226064 | 11/1974 | France | 89/1.13 |
| 2226065 | 11/1974 | France | 89/1.13 |
| 1604011 | 12/1972 | United Kingdom | 89/1.13 |

OTHER PUBLICATIONS

Robotic Obstacle Breaching Assault Tank, (Robot), (photograph only).

*Primary Examiner*—David H. Brown

*Attorney, Agent, or Firm*—Peter A. Taucher; John E. McRae

[57] ABSTRACT

A military tank is equipped with an armored box structure in the space normally occupied by the gun turret. A lid on the box structure is raisable to an inclined position suitable for the firing of a missile carried on the lid undersurface. As the missile is fired an explosive-charged line attached to the missile rear end is drawn out of the box structure onto the terrain (along the missile line-of-flight). By exploding the line charges it is possible to detonate enemy land mines in the vicinity of the charged line.

9 Claims, 12 Drawing Figures

PROTECTIVE BOX FOR EXPLOSIVE LINE LAUNCHER

GOVERNMENT INTEREST

The invention described herein may be manufactured, used, and licensed by or for the Government for governmental purposes without payment to us of any royalty.

BACKGROUND AND SUMMARY OF THE INVENTION

In the field of military science, the destruction of enemy land mines in a systematic manner is complicated by the fact that under battlefield conditions exploding enemy shells and grenades can create a smoky fog-like condition in the atmosphere where the enemy mines have been laid. Such smoky conditions make the detection of enemy mines difficult. Once an enemy mine field is detected (or located) destruction of the mines is complicated by the fact that enemy fire may be concentrated on the general area in front of the mine field. Use of foot soldiers in the area can be quite dangerous.

It has been proposed to utilize tanks as mine destruction mechanisms. In one experimental proposal, a conventional M60 tank was equipped with a system of mine rollers constructed generally along the lines of the mine roller system shown in U.S. Pat. No. 2,455,636. Additionally, the tank was modified to include a missile-launched explosive-charged line mechanism coiled within a container mounted atop the tank. The line had a length of about one hundred twenty yards. The explosive-charged line extended along a strong flexible cable coextensive in length with the line. One end of the cable was attached to the missile; the other end of the cable was attached to the container carried by the tank.

In a test of the above-described system, a tank, modified as described above, was driven toward an area containing rows of buried simulated enemy mines. As the tank approached the mined area, its mine-roller system passed over a mine in the first row of the mine field, causing that mine to detonate; the mine rollers were designed to have sufficient mass to absorb the blast of a single exploding mine.

When the first mine was detected by the mine roller system, the tank was stopped and backed up a distance of approximately fifty feet. The aforementioned missile was then fired from the tank over the simulated enemy mine field. The propellant charge in the missile was selected so that the missile was caused to land at a point about one hundred yards from the tank; during its flight the missile drew the aforementioned cable and explosive-charged line out of a container mounted on the tank. When the missile landed the cable and explosive-charged line lay on the terrain in a substantially straight line spanning the rows of enemy mines. The explosive-charged line occupied an area between the missile and the tank.

After the missile had landed, the explosive charges along an approximately one hundred yard length of line were detonated. The explosive charges were of sufficient destructive force to explode any enemy mines previously planted along the one hundred yard length.

Using the described system, it is believed possible to clear a path width of about fifteen feet (seven feet or so on either side of the charged line). A path of this width is sufficient to permit passage of a friendly tank through an enemy mine field, if the path is adequately marked, e.g., by means of colored dye, powder, marker flags, etc.

The present invention is directed to an armored box mechanism designed for installation on an M60 tank to enclose and protect the missile unit and explosive-charged line assembly utilized in the above-described mine destruction system. Such protection is needed especially during the time when the tank is searching for the enemy mine field and launching the missile.

OBJECTS OF THE INVENTION

General objects of the invention are to provide an armored box mechanism for protecting a missile launch unit and explosive-charged line, wherein:

1. two (duplicative) missile launch, explosive-charged line systems are accommodated on a single tank;
2. a reasonably low tank silhouette is maintained;
3. structural modifications to the tank structure are kept at a minimum;
4. the tank is operable on the battlefield, either manually by human technicians located within the tank, or electronically by remote signal from relatively safe locations away from the battle front, e.g., radio or fiber optic link;
5. the armored box mechanism is manufacturable as a self-contained unit separate from the tank on which it is to be installed.
6. the armored box mechanism is readily lifted as a unit and installed on a conventional tank without need for precision machining or fitting operations;
7. the armored box mechanism has access openings therein permitting relatively easy loading of an explosive-charged line into the mechanism;
8. the armored box mechanism is designed to protect the crew from injury due to exploding enemy shells in or near the armored mechanism.

THE DRAWINGS

FIG. 1 SYSTEM

Figure 1:
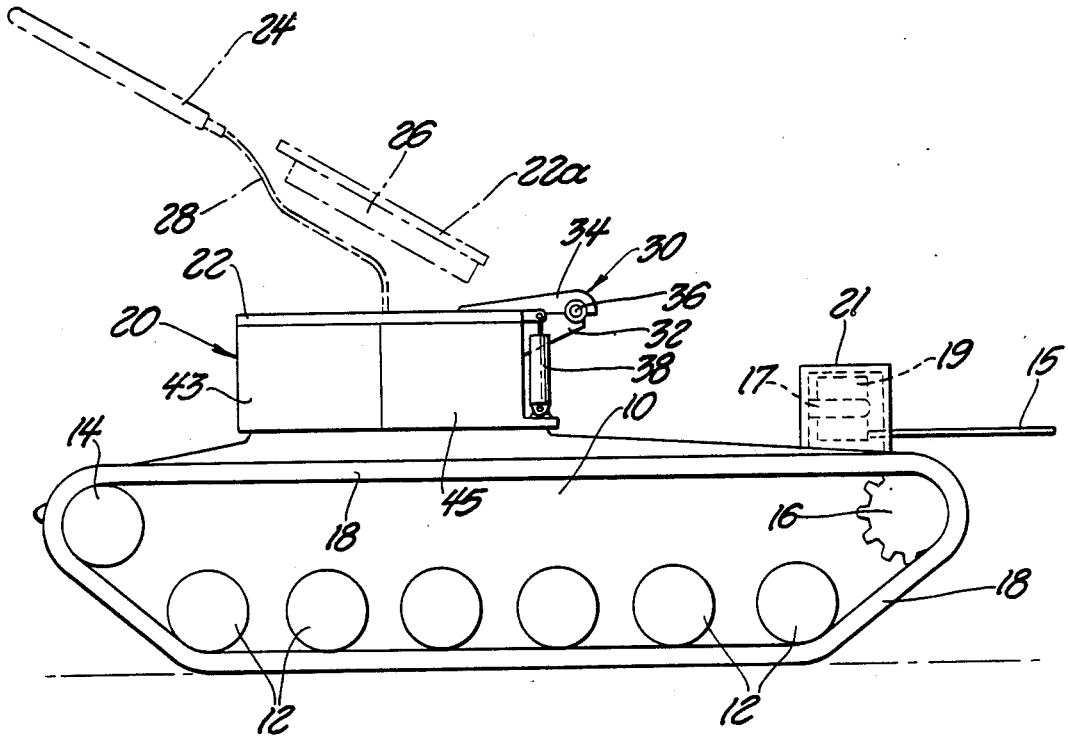
FIG. 1 is a side elevational view of a military tank incorporating our invention.

FIG. 1 illustrates the genera1 features of a military tank incorporating the present invention. The tank comprises a hull 10 having road wheels 12, front idler wheels 14 and rear sprocket wheels 16. Ground-engagable tracks 18 are trained around the various wheels. An engine-transmission power pack within the hull is operatively connected to sprocket wheels 16 to provide the necessary propulsion force. Steering may be accomplished in conventional fashion, i.e., by operating the two sprocket wheels 16 at different speeds, e.g., holding one sprocket wheel motionless while operating the other sprocket wheel in a forward or reverse direction.

The FIG. 1 tank may be a conventional tank, designated by the U.S. military as the M60. The tank is modified in that the conventional turret and main gun are removed; additionally the turret basket (that extends from the turret into hull 10) is removed. In the space which the turret would normally occupy, we mount an armored wall mechanism designated generally by numeral 20. This mechanism comprises two box-like structures arranged side-by-side on a horizontal plate that is affixed to the turret guide ring portion of hull 10. The horizontal plate is not visible in FIG. 1. Within the broader aspects of the invention, more or less than two box-like structures could be used.

The two box-like structures provide bullet-resistant housings for two missile-launcher units and associated explosive-charged line devices. These units and devices are not visible in FIG. 1. FIG. 1 shows in dashed lines a lid 22 for one of the boxes raised to an inclined missile-firing position designated by numeral 22*a*. As seen in FIG. 1 (dashed lines) a missile (or rocket) 24 has just been fired from a launcher 26 that is suspended from the undersurface of lid 22. The trailing end of the missile has an explosive-charged line and cable attached thereto, such that as the missile takes flight along a predetermined trajectory, it draws incremental lengths of the line-cable system out of the armored box and onto the terrain in front of the tank; the explosive-charged line and cable are collectively designated by numeral 28. Certain sections of the line carry explosive charges which, when detonated, cause destruction of enemy land mines located along the path taken by the missile-line system.

At times other than the missile-launch period, each lid 22 is in its FIG. 1 full line position closing the armored box, thus protecting the missile-line system from enemy grenade attack or small arms fire. The walls of the two box-like structures are preferably formed of hardened steel plate approximately two inches thick, to provide the necessary protection against enemy attack.

Each lid 22 is connected to the subjacent box structure by means of a hinge mechanism 30 that includes a pair of spaced brackets 32 exending rearwardly from the box structure and a pair of spaced brackets 34 extending rearwardly from lid 22. A transverse pivot shaft 36 interconnects the various brackets.

The relatively large weight of each lid 22 is such that a powcr mechanism is required to elevate the lid between its closed position (full lines) and its open position (dashed lines). In the FIG. 1 system, the power mechanism takes the form of a fluid cylinder 38 having its lower end connected to the box rear wall and its upper (piston) end connected to lid 22 at a point offset forwardly from pivot shaft 36.

FIG. 2

Figure 2:
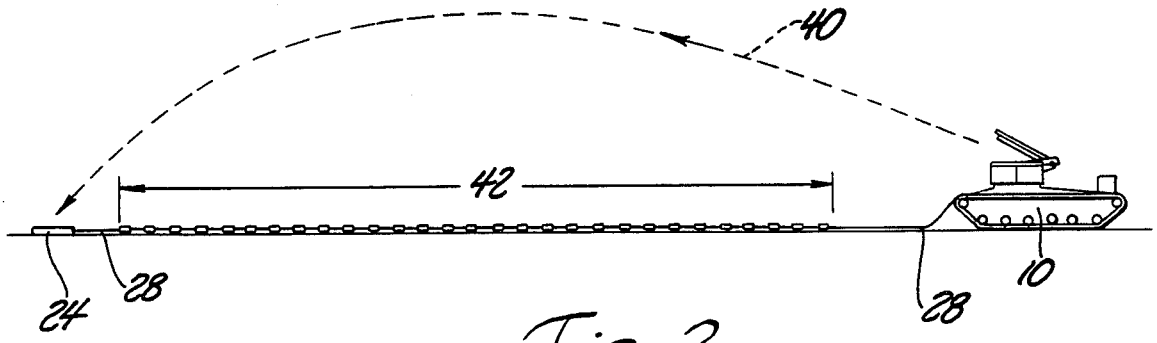
FIG. 2 is a reduced scale view of the FIG. 1 tank, showing an explosively-charged line fired onto the terrain.

FIG. 2 diagrammatically illustrates the general condition of a missile-charged line (or cable) system 28 after the missile has been fired from the tank along flight path line 40. The missile is at that time connected to the tank via cable 28 lying on the terrain. An intermediate section of the line, designated by numeral 4, has a series of explosive charges attached thereto (or contained therein if the line has a hollow hose-like character). Detonation of such explosive charges will destruct any enemy land mines in zones located alongside line section 42.

Detonation of the explosive charges in cable section 42 may be accomplished electrically via a detonator squib connected to an electrical line running along the cable from the tank. The detonator signal may be generated from the tank into the rightmost end of the igniter lines. The explosive charges are detonated only after the missile has landed.

SYSTEM OPERATION

FIG. 2 partially illustrates system operation. In a typical scenario, tank 10 would be equipped with a conventional mine roller mechanism at its front end (rollers are about six feet in front of the tank hull). The tank might also be equipped with smoke grenade launchers mounted on the front surface of wall mechanism 20 (to conceal the tank from the enemy force). The tank would proceed forwardly toward the enemy position until the mine rollers detonated the first-encountered enemy mine. The tank would then be backed up a short distance to a stationary position facing the enemy mine field.

One of the missiles 24 (FIG. 1) would be fired over the mine field to achieve the condition depicted in FIG. 2. After the charged line had been exploded to clear the path distance 42, the line 28 would be detached from tank 10. The tank would then be driven forwardly along and through the cleared path 42.

If another mine belt were encountered at or near the forward limit of cleared path 42, the tank would be stopped to fire the other missile 24 (housed in the second armored box). The fired missile and attached charged line would provide a second cleared path distance similar to that depicted in FIG. 2.

After the two missiles had been fired and the two line charge systems detonated, the tank would (or might) be driven forward along the original path (defined by the detonated mines), thereby causing the mine rollers to detonate any enemy mines beyond the reach of the two charged lines.

Preferably the tank would be equipped with a lane marking mechanism to indicate to our own troops the exact location of the cleared path. Such lane marking mechanism (not part of the present invention) is carried on the rear end of the tank hull to form markings on the terrain as the tank proceeds in the forward direction through the enemy mine field. Lane marking can take the form of chemiluminescent light sticks, marking flags, etc.

The tank can be driven manually into the enemy mine field. However, it is possible to operate the tank remotely (without any humans in the tank). Such remote operation has already been demonstrated in at least one test operation carried out in the summer of 1981.

Remote operation of the tank (and operations to launch the missiles and detonate the line charges) uses a video camera on the front end of the tank and a video receiver at the remote control point when line-of-sight observation is not possible. Two-way signal connections betwen the remote control point and the tank may be accomplished via radio signal and or fiber optic cable connections.

FIBER OPTIC CABLE CONTROL SYSTEM (FIG. 1)

FIG. 1 fragmentarily illustrates one manner of operably attaching a fiber optic cable 15 to the tank. The fiber optic cable may be wound as a coil 19 on a stationary spindle (reel) 17 located within an armored housing 21 mounted at the rear and of the tank hull. The other end of the fiber optic cable is connected to a control box (not shown) located outside the tank. A technician attends the control box while the tank proceeds forwardly from the remote control point toward the enemy position. As the tank moves away from the control point, the fiber optic cable winds off of spindle 17 without any impeding effect on the hull.

The fiber optic cable has several optical filaments running therealong, for such purposes as vehicle steering, vehicle direction (forward-rearward), missile firing, line charge detonation, line separation from the tank, lane marking, video camera on-off control, and video camera output signal. Optical- electrical transducers are located in the tank and in the remote control box to translate optical signals into useful electrical pulses. The remote control box would usually be located a safe distance back from the battlefront, e.g., about 2000 yards.

FIG. 1 shows one reel 17 and associated fiber-optic cable 15; the reel is located within an armored housing 21 (formed of armor plate). To provide for control redundancy three such reel-cable assemblies are installed on the tank; each reel is located within an armored housing. The various housings 21 are located side-by-side at the back of the vehicle. As seen in FIG. 1, only one of the housings is visible (the other housings are hidden).

As previously indicated, our invention relates primarily to the construction of the armored box mechanisms 20 disposed in the area normally occupied by the turret. Features of interest are depicted primarily in FIGS. 3 through 5 and 8 through 12.

FIGS. 3–5 BOX STRUCTURE

Figure 3:
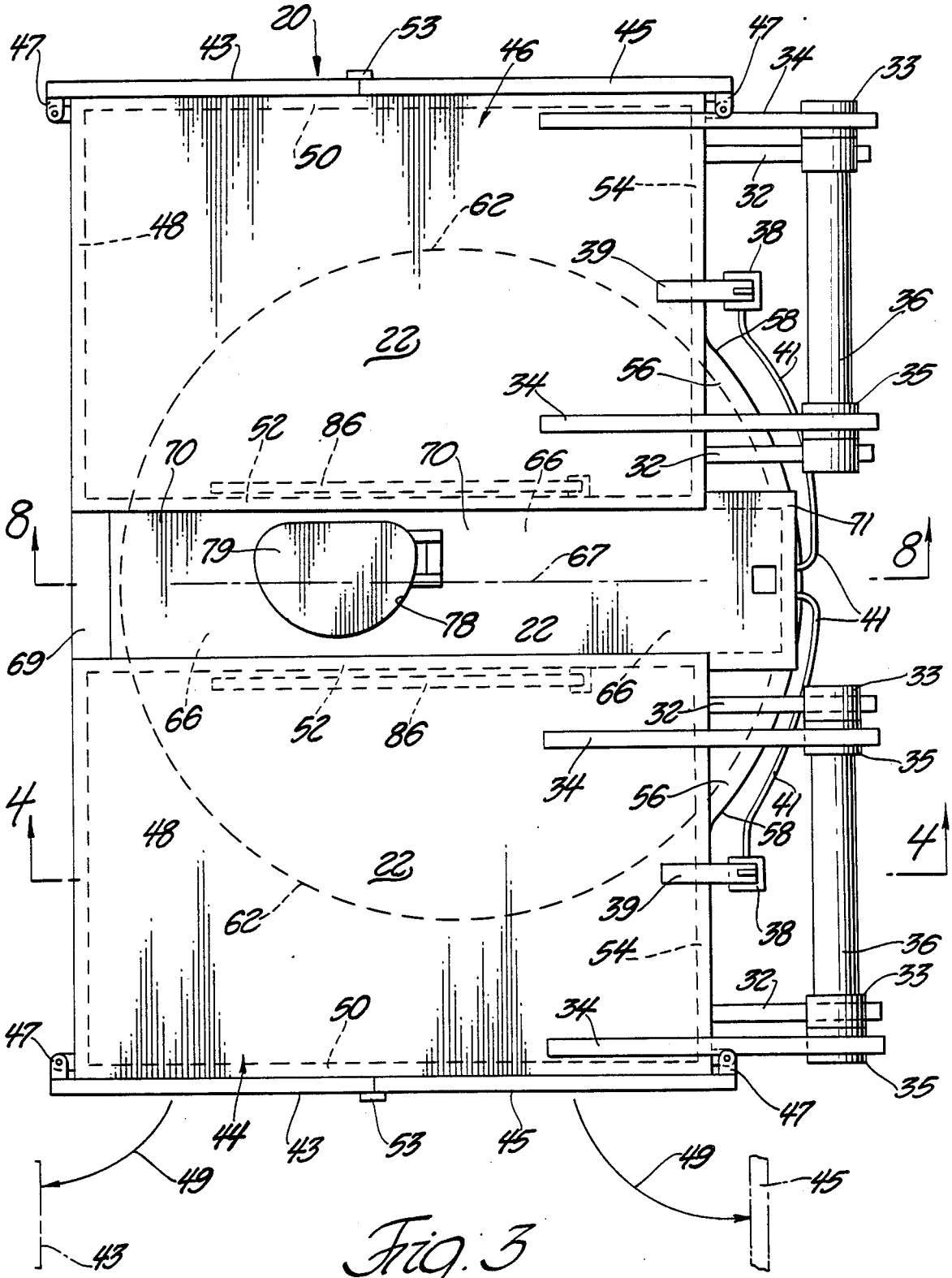
FIG. 3 is an enlarged top view of a protective box structure used on the FIG. 1 tank.
Figure 4:
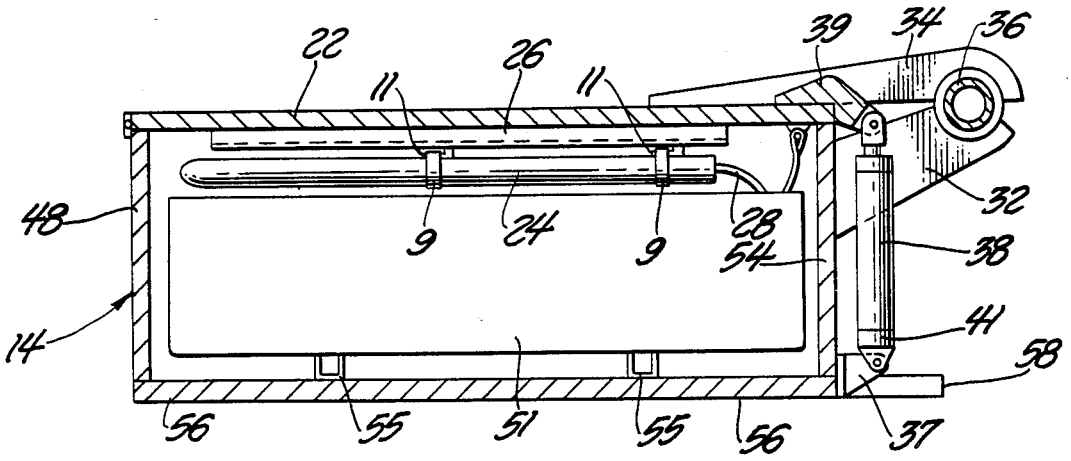
FIG. 4 is a fragmentary sectional view on line 4—4 in FIG. 3.
Figure 5:
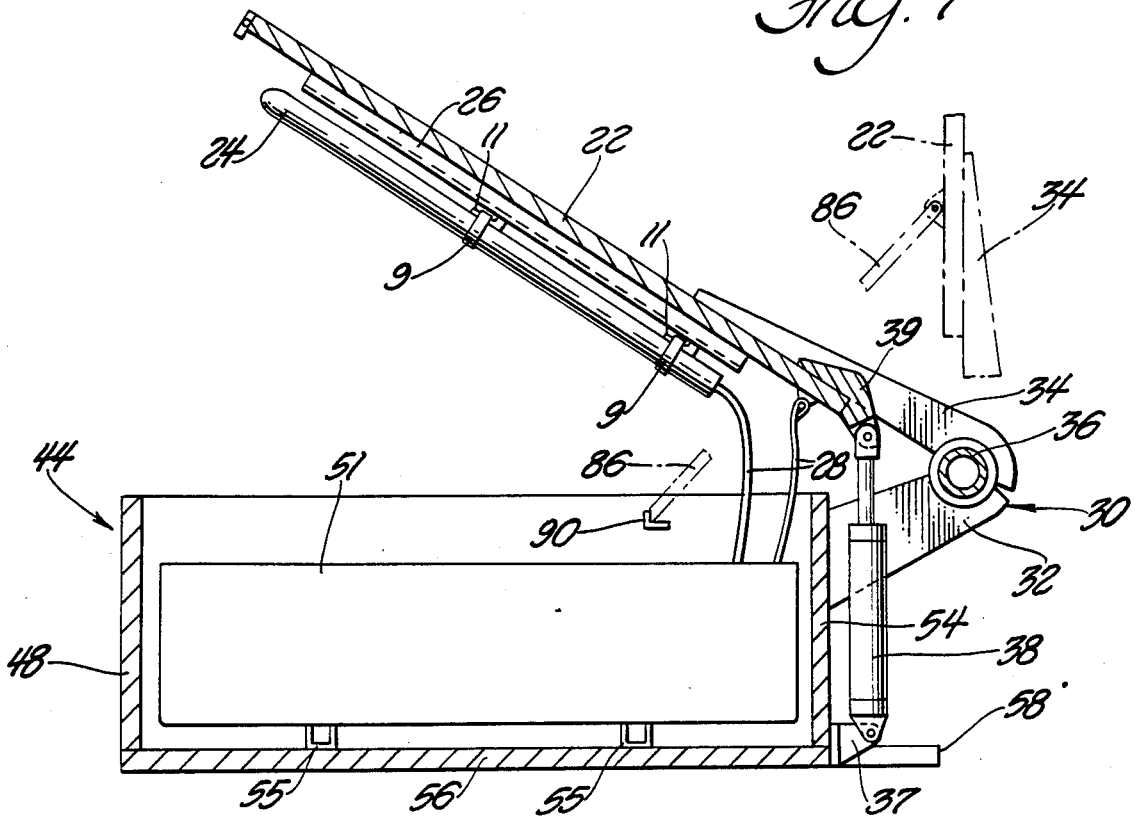
FIG. 5 is a sectional view taken in the same direction as FIG. 4, but with a missile launcher in firing position.
Figure 6:
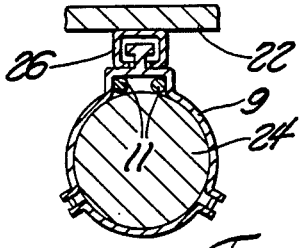
FIG. 6 is a fragmentary sectional view taken through the missile-launcher assembly shown in FIGS. 4 and 5.
Figure 8:
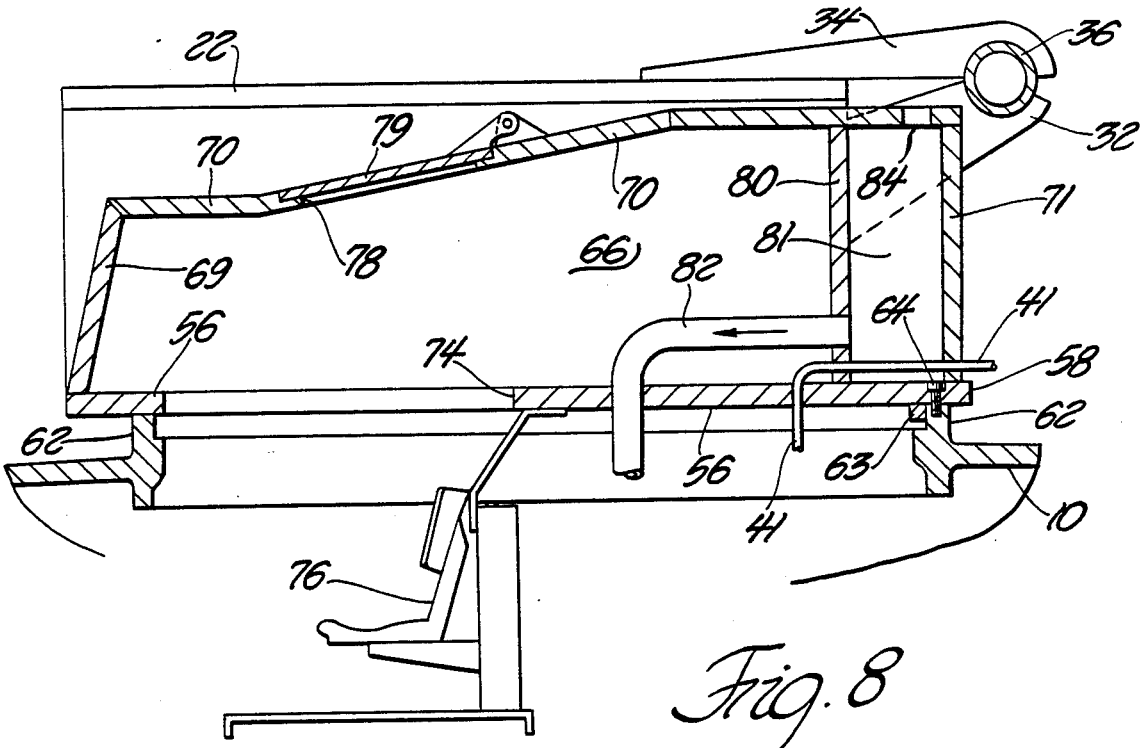
FIG. 8 is a sectional view taken on line 8—8 in FIG. 3.

FIG. 3 is a top plan view of two similar box mechanisms forming component parts of armored wall structure 20; the respective box mechanisms are designated by numerals 44 and 46. Each box mechanism includes a front wall 48, two side walls 50 and 52, and a rear wall 54. Each of these walls extends vertically upwardly from a common horizontal Plate 56 (FIGS. 4, 5 and 8). The plate and vertical walls are formed of thick armor plate material, e.g., two inch thick.

Plate 56 serves as a common bottom wall for both box mechanisms 44 and 46. Plate 56 has a generally rectangular configuration, except for a circular edge configuration 58 where the plate rear edge is required to follow the circular contour of the upstanding turret-support wall 62 carried by hull 10 (see FIG. 8).

Plate 56 may be affixed to existing ring-like wall 62 of the hull by any appropriate means, e.g., welding or bolting. As shown in FIG. 8, the connection is made by means of bolts 64 extendable through plate 56 into threaded openings in wall 62. Such openings are pre-existing in the conventional tank structure for the purpose of retaining the turret and its ball race structure in place on the hull. Locator blocks 63 may be welded to the underside of plate 56 as added assurance of a firm plate-hull connection.

FIGS. 3 through 5 show some interior details of the armored wall box mechanisms 44 or 46, especially details of the aforementioned hinge mechanisms 30. Bracket arms 32 are welded to box walls 54; they carry collars 33 which encircle tubular shaft 36 Bracket arms 34 are welded to lid 22; they carry collars 35. Shaft 36 may be affixed to collars 33 or collars 35. Shaft 36 is preferably a hollow tubular structure to minimize weight and also (optionally) to provide a conduit for electrical wires used to initiate a missile launch operation.

The aforementioned fluid cylinder(s) 38 are attached to the box rear walls 54 by means of bracket(s) 37; the piston portions of the fluid cylinders are attached to lids 22 via brackets 39. Hydraulic fluids are fed to and from the lower ends of cylinders 38 via four tubes 41 extending from central space 66 (FIG. 3) provided between the two boxes 44 and 46. A pre-existing hydraulic power supply within the tank is connected to tubes 41.

The outer side surface of each box mechanism 44 or 46 is defined by two heavy steel doors 43 and 45 held closed by non-illustrated manual latch means. Each door is connected to the front or rear wall of the associated box via a hinge structure 47. The doors are adapted to be swung open (manually) as indicated by directional arrows 49 (FIG. 3). When the doors are in their open positions substantially the entire outer side of the associated box is accessible to permit a container 51 to pass therethrough. The joint between the two doors 43 and 45 is closed (concealed) by a steel strip 53 welded to door 45. Strip 53 provides protection against enemy fire or explosion force passing through the joint into the box interior to detonate line charges within container 51.

Each container 51 is a box-like receptacle having a bottom wall and four upstanding side walls; the top of each container is left open. The aforementioned cable-charged line system 28 is stored or housed within container 51 in coiled or serpentine fashion. Thc cable-linc assembly occupies substantially the entire space circumscribed by container 51.

Each container 51 is pre-loaded with an explosive-charged cable prior to loading of the container into the armored box structure (44 or 46). The loaded container may be inserted into the armored box through the side of the box (after doors 43 and 45 have been opened). Alternately, the box can be inserted into the armored box through the open top of the box. In such case, the fluid cylinders 38 must first be operated to orient lid 22 into a vertical attitude (i.e., extending normal to plate 56). A safety brace 86 may be hingedly attached to the underside of each lid 22 to act as a back up support for the lid when it is in its vertical attitude (dashed lines in FIG. 5). A sockct 90 may be formed on the associated box side wall 52 to engage the free end of each brace.

The direction of container insertion into the armored box is dictated largely by the type of material-handling equipment available at the site. If a forklift-truck is available, container 51 can be inserted into the armored box through its side opening; channels 55 on the container bottom wall accommodate the forklift elements. If a crane is available at the loading site, container 51 can be installed in the box by lowering it through the box top opening.

Figure 9:
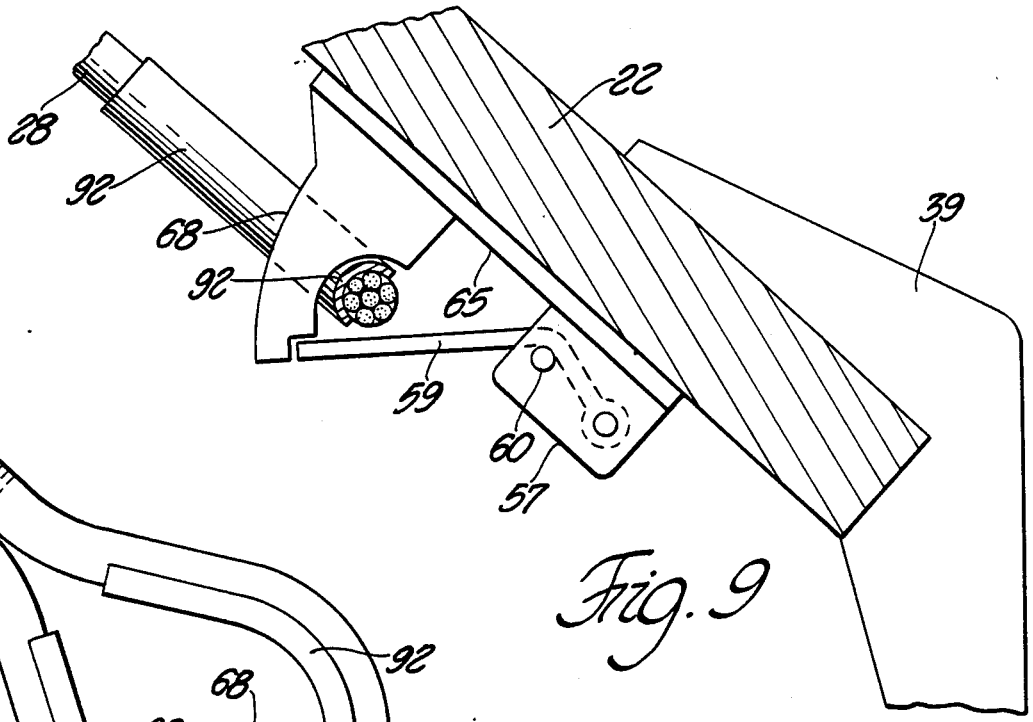
FIG. 9 is a fragmentary enlarged sectional view taken through a releasable cable anchorage mechanism used in the system of FIGS. 3 through 5.
Figure 10:
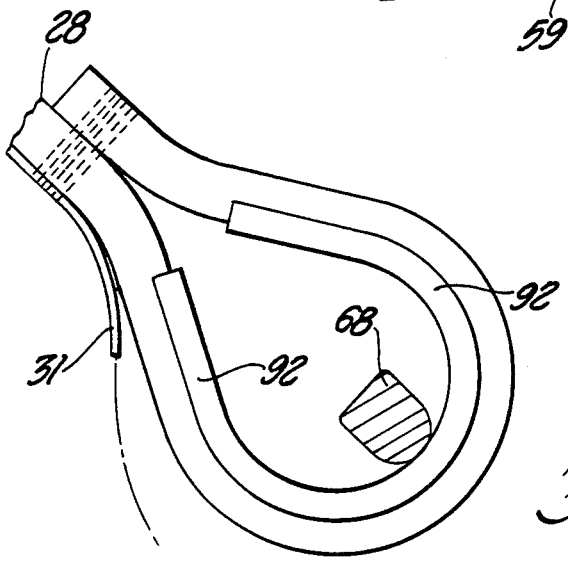
FIG. 10 is a fragmentary sectional view of the FIG. 9 mechanism.
Figure 11:
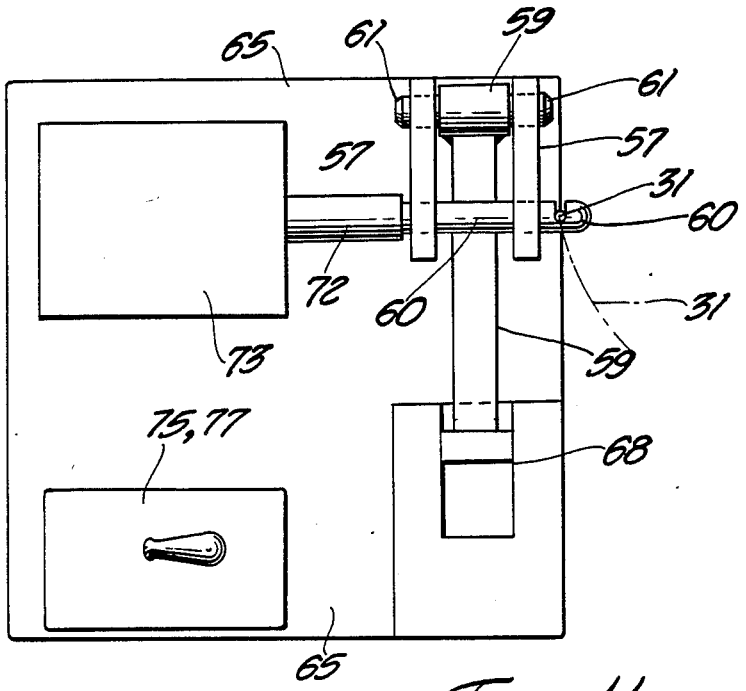
FIG. 11 is a plan view of part of the FIG. 9 mechanism.

After container 51 is located in the armored box, the respective ends of the line-cable system 28 can be connected to the aft end of missile 24 and lid 22. The opposite ends of the cable may have loops thereon adapted to fit onto suitable hooks or similar anchorages on the missile and lid. The anchorage structure on lid 22 may have a detachable connection with the lid to permit separation of the cable from the tank structure after detonation of the line charges. Details of such a detachable connection are shown in FIGS. 9 through 11.

FIG. 7

Figure 7:
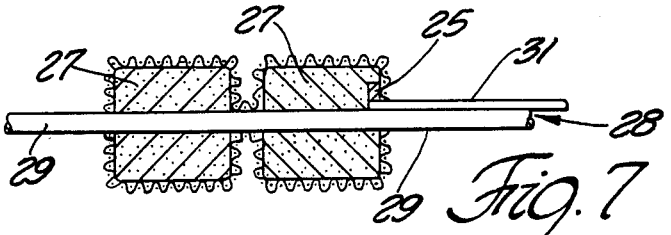
FIG. 7 is a fragmentary view through a explosive-charged line used in the system of FIGS. 3 through 5.

FIG. 7 illustrates one general way in which the cable (line) system can be constructed; other ways are possible. As seen in FIG. 7, cable system 28 comprises a relatively heavy nylon cable 29 and a relatively light electrically-conductive line 31 extending therealong. The electrical line extends from the tank along cable 29 to a detonator 25 located on the first explosive block 27. Each explosive block may be a cylinder or cube measuring about three or four inches on a side; it may be contained within a protective cloth sleeve. When line 31 is electrically energized, the explosive blocks are detonated in series, one after another. Such action will take place after the explosively-charged cable system has been propelled onto the terrain in front of the tank, as shown generally in FIG. 2.

MISSILE LAUNCH OPERATION

Missile launcher 26 is shown in FIGS. 4 and 5 as a slotted rail affixed to the underside of heavy steel lid 22. The missile is supported on the launch rail by two pairs of pins 11 (carried by the rail) and cooperating bands 9 (carried by the missile). The rail has a slot in its lower face adapted to accommodate T-shaped slide elements associated with band 9.

The missile launch operation is initiated by an electric pulse generated from within the tank interior. Electrical wiring extends from the tank interior upwardly through plate 56 and along box wall 54. The wiring can proceed through passageways formed in a bracket 32 and associated collar 33, thence into shaft 36, collar 35, bracket 34 and lid 22. An electrically-energized ingniter in the missile initiates the missile-launch operation.

As the missile leaves thc launcher, cable (line) assembly 28 is drawn out of container 51. After the missile has landed at some point forwardly of the tank, the line charges 27 (FIG. 7) are detonated. The electrical detonation signal may be generated from the tank through an igniter line 31 forming part of assembly 28. Electrical detonation may be accomplished automatically as a time-delayed signal related to the initial missile-launch signal (e.g., sixty seconds after missile launch). Alternatively, or additionally, the detonation may be accomplished manually by the technician in the tank or by the technician at the remote control point. Detonation signal may be controlled by a simple on-off switch.

In a preferred electrical control system, electrical interlocks are built into the system for preventing premature operation of the missile and/or line charges. A first interlock would prevent missile launch until after lid 22 was in a raised position suitable for launching the missile along a desired trajectory; the missile launch operaton can be time-controlled as a response to the lid raise operation. A second interlock would prevent detonation of the line charges until the elapse of a predetermined time following missile launch (e.g., a certain number of seconds based on missile flight time).

The calculated launch angle for lid 22 is based on the flight characteristics of the missile and the length of the cable-line system 28. In one case, design elevation angle for lid 22 (relative to its horizontal closed position) was forty-seven degrees. The launch operation is not particularly difficult to accomplish or control, since the travel distance of the missile can be controlled by selection of propellant mass (so that the missile runs out of fuel when or shortly after it reaches a desired point forwardly from the tank). Should the missile be in flight when cable-line assembly 28 becomes taut, the missile and associated cable-line assembly will merely fall to the ground.

Various control systems can be devised to take into account variations in attitude of the vehicle on hilly terrain. Thus, if the vehicle is located on an upslope of ten degrees, the elevational angle of lid 22 to achieve a desired missile launch angle would be decreased ten degrees from the aforementioned forty-seven degrees (or other calculated launch angle). Angle sensor switches can be incorporated in hinge structure 30 (within hollow shaft 36) to detect lid attitude and tank hull attitude.

FIG. 9—CABLE SEPARATION FROM TANK

After line charge detonation, it is necessary to separate the trailing end of the cable system 28 from the tank. One suitable cable-separator mechanism is shown in FIGS. 9 through 11. As shown, the end of the nylon cable 29 is wrapped around a metal thimble (mandrel) 92 that gives the cable end a looped configuration. The cable looped end encircles a rigid arm 68 protruding from a bracket structure 65 suitably attached to the undersurface of lid 22. An L-shaped latch bar 59 is pivotably connected to bracket 65 for swing motion around the right end of the bar (via pin 61 shown in FIG. 9).

Latch bar 59 is normally retained in its FIG. 9 closed position by means of a transverse pin 60 that is slidably disposed in circular openings in spaced walls 57, 57 on bracket structure 65. As best seen in FIG. 11, pin 60 is an extension of a rod 72 that constitutes an output member for linear motor 73. Motor 73 is a conventional structure that includes a rotary electrical motor (not shown) and internal gearing designed to cause member 72 (and pin 60) to move linearly (to the right or to the left in FIG. 11). Leftward motion of pin 60 frees latch bar 59 for swinging motion in a counterclockwise direction (FIG. 9), enabling cable 28 to separate from arm 68 (by gravity).

The extreme outer end of pin 60 has a notch designed to receive a section of electrical line 31 (used to detonate the explosive charges). As pin 60 moves leftwardly (FIG. 11), the section of line 31 within the notch forcibly contacts the face of wall 57 with sufficient force (e.g., one hundred pounds) to sever the line. Electrical line 31 is severed from the tank structure (lid 22) as part of the operaion of separating cable 29 from the tank (via movement of latch bar 59).

Figure 12:
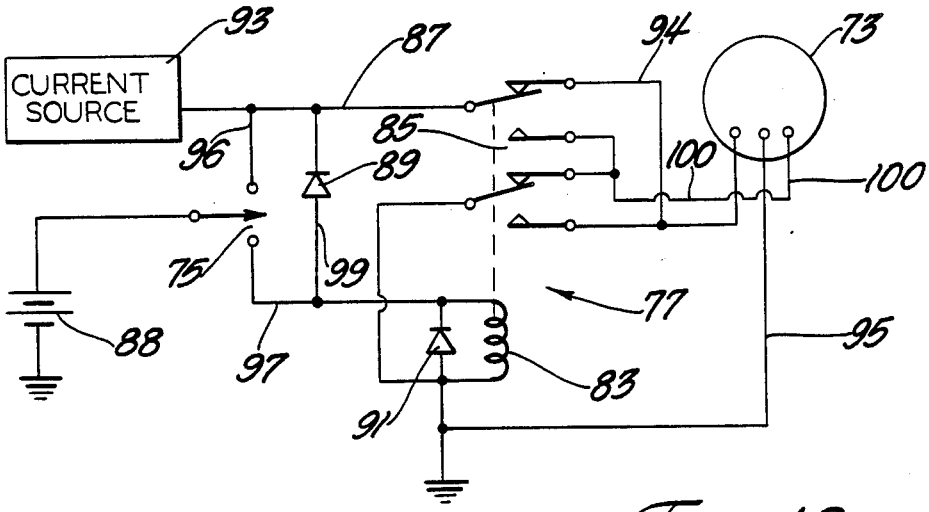
FIG. 12 illustrates an electric circuit used in the FIG. 11 mechanism.

FIG. 12 shows a representative electrical system for operating motor 73 (FIG. 11). Source 93 operates the motor under battlefield conditions (to separate cable 29 from arm 68). Source 88 operates motor 73 when bar 59 is being initially set, or when motor 73 is being tested (away from the battlefield). The control system includes a relay 77 having a winding 83 and multiple controlled contacts 85. When source 93 is energized (battlefield mode) current flows from source 93, through lines 87 and 94, the motor, and ground line 95; this action causes pin 60 to pull in, thereby releasing bar 59 for achieving a cable-separation operation.

During other periods (non-battlefield mode) source 88 is inactive (disconnected). Actuation of switch 75 in an upward direction enables an electrical signal from auxiliary source 88 to operate motor 73 in the cable-separate direction (wherein pin 60 moves to the left); current flows through a path comprising switch 75, lines 96, 87 and 94, the motor and ground line 95. Manual actuation of switch 75 in a downward direction energizes winding 83 (through line 97), which adjusts the controlled contacts 85 to reverse the direction of motor 73. The motor is energized through a path comprising line 99, dode 89, lines 87 and 100, the motor, and ground line 95. The circuitry preferably includes a transient suppression diode 91.

Switch 75 is operable up or down during the process of manually attaching cable 28 to arm 68, and/or during the process of testing motor 73 and associated circuitry. In normal operations, switch 75 is inactive. The "cable-separate" motion of linear motor 73 is controlled by a signal from source 93 through line 87.

FIG. 8—SOLDIER ACCOMMODATION FEATURE

The armored structure preferably includes means enabling human operator(s) to enter or leave the tank. In the FIG. 3 arrangement such entry/exit means is located between the two box mechanisms 44 and 46. As will be seen from FIG. 3, box mechanisms 44 and 46 are laterally spaced from one another, leaving a central free space 66 along the front-to-rear centerline 67 of the tank; FIG. 8 is a cross sectional view taken through space 66. The central portion of plate 56 forms a floor for space 66. Space 66 is utilized to accommodate the head-shoulder portions of a soldier (commander) seated in the tank. The rear portion of central space 66 may be used to house air filtration equipment and hydraulic lines 41 leading to fluid cylinders 38 (FIGS. 3, 4, and 5).

As seen in FIG. 8, central space 66 is enclosed or defined by a front wall 69, roof wall 70 and rear wall 71. A video camera (not shown) may be mounted on the exposed forward face of wall 69; electrical wiring for the video signal and video camera manipulation will extend through wall 69 into space 66. A video monitor could be located directly behind wall 69 (in space 66) or at a remote location reachable by the aforementioned cable 15 (FIG. 1). Each of walls 69, 70 and 71 is formed of a material and thickness sufficient to resist penetration thereof by enemy small arms fire. A clearance opening 74 is formed in plate 56 to accommodate the shoulders of a soldier occupying seat 76 within the tank. The soldier is able to enter or leave seat 76 through a hatch opening 78 located in roof 70 substantially directly above clearance opening 74. Opening 78 is closed by a hatch cover 79, which may be of conventional design.

Central space 66 has an internal partition 80 therein which partially defines a small rear chamber 81. A pump-air fitration unit may be housed within chamber 81 for supplying clean uncontaminated breathing air to an air supply tube 82. The forward end of tube 82 may be connected to a mask structure designed to be worn by the soldier while seated on seat 76. Atmospheric breathing air is admitted through air supply port 84 into the filtration-pumping unit in chamber 81; clean air flows forwardly through tube 82 to the mask worn by the soldier. This type of air supply system would find greatest usage when the vehicle is operating in heavily smoked atmospheres, and/or atmospheres contaminated by the enemy with toxic chemicals or nuclear particulates.

ADVANTAGES OF ILLUSTRATED ARRANGEMENT

A principal advantage of the illustrated structure is the protection offered to the crew and the explosive-charged line system. Armored wall mechanism 20 comprises two separate box structures that entirely surround and protect containers 51 for the explosively charged lines 28. Each container 51 is adequately protected by wall mechanism 20.

Armored mechanism 20 has a relatively small vertical dimension, such that the modified tank has a silhouette approximately the same as that of a conventional tank. The modified tank has a fairly good chance of carrying out its function without unduly drawing enemy fire.

Armored mechanism 20 is subdivided into two box units 44 and 46 for housing two separate explosive line containers 51. The mechanism has a relatively large total explosive line capability, suitable for forming a fairly long cleared path through a relatively deep enemy mine field.

The location of armor mechanism 20 in the space normally occupied by the tank turret is such that the tank center of gravity is approxmately unchanged. The tank retains its original agility and maneuverability (except that the mine rollers reduce the top speed appreciably).

Armored wall mechanism 20 is manufacturable as a separate subassembly, apart from the tank. The armored wall mechanism can be installed on existing tanks, with minimum modifications to the tank structure. When the mine-clearing function is no longer needed, mechanism 20 can be removed and the original turret reinstalled on the tank. Since plate 56 serves as a common floor (bottom wall) for both boxes 44 and 46, the armored wall mechanism has a self-rigidity and unitary structure that facilitates installation and/or removal relative to a pre-existing tank.

In use, armored wall mechanism 20 can be quickly loaded with pre-loaded containers 51, either through the side openings in box walls 50 or through top openings closed by lids 22. Forklift or crane type material-handling equipment may be used, according to type of equipment on hand.

Plate 56 is a relatively massive unitary barrier between the explosively-charged lines and the two-man crew. In the event of inadvertant detonation of the line charges while the charged line is still within the armored wall mechanism the explosive force will be directed outwardly and/or upwardly, rather than downwardly through plate 56. Side doors 43 and 45 will act as safety (blast-open) devices. The openings closed by doors 43 and 45 are relatively large openings, such that practically the entire blast force will be directed laterally and outwardly (instead of downwardly); the door latches would be blasted loose during such blast operation.

Fluid cylinders 38 are oriented relatively close to box walls 54 in positions partially protected from enemy attack. If desired, armor walls could be installed around cylinders 38. The relationship between cylinders 38 and hinges 30 is such that when lids 22 are in their fully-open positions (normal to plate 56) the entire box top opening is accessible for the purpose of down-loading container 51 into the armored box.

The cable-separating structure shown in FIGS. 9 through 11 is believed to be a relatively simple low-cost device for achieving automatic operation, with little likelihood of failure. The device is effective to separate both the cable and the detonator line in one operation.

The auxiliary housing structure shown in FIG. 8 adds somewhat to the overall utility of the system in that it facilitates entry or exit of humans into the tank structure. Hatch cover 79 is located somewhat below the level of box lids 22 such that the soldier is partially concealed from areas alongside the tank while he is entering or leaving the vehicle. This feature would come into play in battlefield operations, should it be necessary for the soldier(s) to leave the vehicle while exposed to enemy fire.

We wish it to be understood that we do not desire to be limited to the exact details of construction shown and described for obvious modifications will occur to a person skilled in the art, without departing from the spirit and scope of the appended claims.

We claim:

1. In association with a military tank that includes an armored hull having a top wall formed with a circular opening therein designed to rotatably accommodate a gun-mounting turret;

the improvement comprising a mine destruction mechanism substitutable for the turret on the hull; said mine destruction mechanism comprising a horizontal plate (56) affixed to the hull top wall in overlying relation to the aforementioned circular opening; two laterally-spaced boxes mounted on the horizontal plate in the space that would otherwise be occupied by the turret, a missile launcher unit contained in each box, and an explosive-charged line connected to each missile, each explosive-charged line occupying space within the box beneath the associated missile;

each box comprising a front wall (48), inner side wall (52) and rear wall (54), each of said walls extending generally vertically upwardly from the horizontal plate whereby said plate forms a common bottom wall for the two boxes, each box further comprising a lid (22) having a hinged connection with the box rear wall, said lid having a closed position extending generally horizontally across the upper edges of the aforementioned walls to close the circumscribed space, said lid and box walls being formed of armor material resistant to penetration by enemy fire;

each missile-launcher unit being mounted on the undersurface of the associated lid, with the launcher oriented to discharge the missile in a forward direction;

a vertically-oriented fluid cylinder means located in the space behind each box rear wall, one end of each fluid cylinder means being operatively connected to the box rear wall, the other end of each fluid cylinder means being operatively connected to the lid at a point offset from the hinged connection, whereby operation of the fluid cylinder means swings the lid upwardly to a forwardly inclined position wherein the launcher is set to fire its missile at a predetermined elevation angle calculated to draw the associated explosive-charged line out of the box and along a straight line onto the terrain in front of the tank;

said inner side walls of the two boxes being laterally-spaced from one another, leaving a central space along the front-to-rear centerline of the tank; an armored front wall, armored roof wall (70) and armored rear wall spanning the central space between the boxes, such that a soldier can be seated within the tank with his head in the central space without being exposed to enemy fire; said horizontal plate having a clearance opening there through communicating the aforementioned central space with the tank interior; said clearance opening being located in the forward area of the plate to accommodate the shoulders of a soldier seated in the tank; said armored roof wall having a hatch opening therein substantially directly above the aforementioned clearance opening in the horizontal plate, and a hatch cover removably closing the hatch opening; said hatch opening being sized to permit a soldier to enter or leave the tank.

2. The improvement of claim 1 wherein said armored roof wall (70) is located below a horizontal plane containing the box lids (22), whereby a soldier is at least partially protected from enemy fire when passing through the hatch opening;

the hinged connection between each lid and the associated box rear wall comprising a horizontal pivot shaft located a substantial distance behind the box rear wall; each fluid cylinder means being located closely adjacent the rear wall of the associated box to operatively engage the lid at a point in front of the horizontal pivot shaft.

3. The improvement of claim 1 wherein each explosive-charged line is stored within a container sized to fit into one of the boxes; the outmost side of each box having an access opening there through of sufficient dimension to permit passage of a charged line container into or out of the box; and closure means for each access opening formed of armor material resistant to penetration by enemy fire.

4. The improvement of claim 3 wherein each closure means comprises two cooperating closures swingably connected to different ones of the box corners for movements in horizontal planes, to uncover or cover the associated access opening.

5. In association with a military tank that includes an armored hull having a top wall formed with a circular opening therein designed to rotatably accommodate a gun-mounting turret:

the improvement comprising a mine destruction mechanism substitutable for the turret on the hull; said mine destruction mechanism comprising two similarly-constructed boxes mounted on the hull in the space that would otherwise be occupied by the turret, a missile launcher unit contained in each box, and an explosive-charged line connected to each missile, each explosive-charged line occupying space within the box beneath the associated missile-launcher unit;

each box comprising a front wall, side walls and a rear wall, each of said walls extending generally vertically upwardly from the hull, each box further comprising a lid having a hinged connection with the box rear wall, said lid having a closed position extending generally horizontally across the upper edges of the aforementioned walls to close the circumscribed space, said lid and box walls being formed of armor material resistant to penetration by enemy fire;

each missile-launcher unit being mounted on the undersurface of the associated lid, with the launcher oriented to discharge the missile in a forward direction;

a vertically-oriented fluid cylinder means located in the space behind each box rear wall, one end of each fluid cylinder means being operatively connected to the box rear wall, the other end of each fluid cylinder means being operatively connected to the lid at point offset from the hinged connection, whereby operation of the fluid cylinder means swings the lid upwardly to a forwardly inclined position wherein the launcher is set to fire its missile at a predetermined elevation angle calculated to draw the associated explosive-charged line out of the box and along a straight line into the terrain in front of the tank;

the hinged connection between each lid and the associated box rear wall comprising a horizontal pivot shaft located a substantial distance behind the box rear wall; each fluid cylinder means being located closely adjacent the rear wall of the associated box to operatively engage the lid at a point in front of the horizontal pivot shaft.

6. The improvement of claim 5 wherein each explosive-charged line is stored within a container (51) sized to fit closely into one of the boxes; the outermost side of each box having an access opening there through of sufficient dimension to permit passage of a charged line container into or out of the box; and closure means for each access opening; each closure means comprising two cooperating closures swingably connected to corner areas of the box for movements to uncover the associated access opening for loading a container into the box; the cooperating closures being openable in response to blast forces generated from within the associated box, but being resistant to deformation or destruction by enemy fire from outside the box.

7. In association with a military tank that includes an armored hull having a top wall formed with a circular opening therein designed to rotatably accommodate a gun-mounting turret:

the improvement comprising a mine destruction mechanism substitutable for the turret on the hull; said mine destruction mechanism comprising two similarly-constructed boxes mounted on the hull in the space that would otherwise be occupied by the turret, a missile-laucher unit contained in each box, and an explosive-charged line connected to each missile, each explosive-charged line occupying space within the box beneath the associated missile-launcher unit;

each box comprising a front wall, side walls and rear wall, each of said walls extending generally vertically upwardly from the hull, each box further comprising a lid having a hinged connection with the box rear wall, said lid having a closed position extending generally horizontally across the upper edges of the aformentioned walls to close the circumscribed space, said lid and box walls being formed of armor material resistant to penetration by enemy fire;

each missile-launcher unit being mounted on the undersurface of the associated lid, with the launcher oriented to discharge the missile in a forward direction;

a vertically-oriented fluid cylinder means located in the space behind each box rear wall, one end of each fluid cylinder means being operatively connected to the box rear wall, the other end of each fluid cylinder means being operatively connected to the lid at a point offset from the hinged connection, whereby operation of the fluid cylinder means swings the lid upwardly to a forwardly inclined position wherein the launcher is set to fire its missile at a predetermined elevation angle calculated to draw the associated explosive-charged line out of the box and along a straight line onto the terrain in front of the tank;

one end of each explosive-charged line having a separable connection with the associated box lid; each said separable connection comprising an arm (68) depending from the lid, and a latch bar (59) normally contacting an outer tip area of the arm to hold a looped end of the line on the arm, and means (60, 73) operable to release the latch bar from its normal position, whereby the line can separate from the arm.

8. The improvement of claim 7 wherein the release means comprises a member (60) movable transversely across the latch bar to achieve the release action.

9. The improvement of claim 8 wherein each latch bar is swingably mounted for gravitational motion away from the associated arm (68) when the release means is operated.

* * * * *

UNITED STATES PATENT AND TRADEMARK OFFICE

CERTIFICATE OF CORRECTION

PATENT NO. : 4,671,162

DATED : June 9, 1987

INVENTOR(S) : Arthur H. Adlam et al.

It is certified that error appears in the above-identified patent and that said Letters Patent is hereby corrected as shown below:

Column 3, line 62, "powcr" should read -- power --.

Column 6, line 58, "sockct" should read -- socket --.

Column 8, line 61, "operatlng" should read -- operating --.

Column 9, line 5, "88" should read -- 93 --.

Column 9, line 15, "dode" should read -- diode --.

Signed and Sealed this

Twenty-seventh Day of October, 1987

*Attest:*

DONALD J. QUIGG

*Attesting Officer*

*Commissioner of Patents and Trademarks*